US010351989B2

(12) United States Patent
Bison et al.

(10) Patent No.: US 10,351,989 B2
(45) Date of Patent: Jul. 16, 2019

(54) APPLIANCE FOR DRYING LAUNDRY WITH ENHANCED OPERATION FLEXIBILITY

(71) Applicant: Electrolux Appliances Aktiebolag, Stockholm (SE)

(72) Inventors: Alberto Bison, Porcia (IT); Francesco Cavarretta, Porcia (IT); Maurizio Ugel, Porcia (IT); Massimiliano Vignocchi, Porcia (IT)

(73) Assignee: Electrolux Appliances Aktiebolag (SE)

( * ) Notice: Subject to any disclaimer, the term of this patent is extended or adjusted under 35 U.S.C. 154(b) by 583 days.

(21) Appl. No.: 14/902,967

(22) PCT Filed: Jul. 9, 2013

(86) PCT No.: PCT/EP2013/064498
§ 371 (c)(1),
(2) Date: Jan. 5, 2016

(87) PCT Pub. No.: WO2015/003741
PCT Pub. Date: Jan. 15, 2015

(65) Prior Publication Data

US 2016/0138208 A1 May 19, 2016

(51) Int. Cl.

| | |
|---|---|
| ***F26B 21/06*** | (2006.01) |
| ***D06F 58/20*** | (2006.01) |
| ***D06F 58/28*** | (2006.01) |
| ***D06F 58/24*** | (2006.01) |

(52) U.S. Cl.
CPC ..... *D06F 58/206* (2013.01); *D06F 58/24* (2013.01); *D06F 58/28* (2013.01)

(58) Field of Classification Search
CPC ..... D06F 58/206; D06F 58/24; D06F 58/28
(Continued)

(56) References Cited

U.S. PATENT DOCUMENTS 5,852,881 A * 12/1998 Kuroda ..... D06F 58/28 34/527
2005/0198852 A1* 9/2005 Ono ..... D06F 58/206 34/77

(Continued)

FOREIGN PATENT DOCUMENTS

AU 2011244860 5/2012
CH 701466 12/2010

(Continued)

OTHER PUBLICATIONS

Chinese Office Action dated Feb. 6, 2017 in corresponding Chinese Application No. 201380077987.0.

(Continued)

*Primary Examiner* — Kenneth Rinehart
*Assistant Examiner* — Bao D Nguyen
(74) *Attorney, Agent, or Firm* — RatnerPrestia

(57) ABSTRACT

A laundry drying appliance having a cabinet, a treatment chamber inside the cabinet, a drying air recirculation path for conveying air into/out from the treatment chamber, a drying air propeller driven by a drying air propeller motor for causing the drying air to recirculate along the recirculation path, a drying air moisture condensing and heating system the drying air recirculation path for dehydrating the moisture-laden drying air leaving the treatment chamber and heating the dehydrated drying air before it re-enters into the treatment chamber, a laundry drying cycle selector for selecting one out of a number of default laundry drying cycles, a control unit to control the machine operation by operating the drying propeller at a default average speed corresponding to the selected drying cycle, and a command input operable by the user to change an average working speed of the drying air propeller.

16 Claims, 7 Drawing Sheets

(58) Field of Classification Search
USPC ..... 34/77, 492
See application file for complete search history.

(56) References Cited

U.S. PATENT DOCUMENTS

| | | | | |
|---|---|---|---|---|
| 2010/0242297 | A1* | 9/2010 | Balerdi Azpilicueta | D06F 58/206 34/73 |
| 2010/0307018 | A1* | 12/2010 | Driussi | D06F 58/206 34/79 |
| 2014/0041249 | A1* | 2/2014 | Jung | D06F 58/206 34/282 |

FOREIGN PATENT DOCUMENTS

| | | | | |
|---|---|---|---|---|
| CH | 701466 | A2 * | 12/2010 | D06F 58/206 |
| CN | 1888264 | A | 1/2007 | |
| CN | 102535106 | A | 7/2012 | |
| CN | 102535125 | A | 7/2012 | |
| CN | 102560993 | A | 7/2012 | |
| DE | 102008007564 | | 8/2009 | |
| EP | 1852541 | | 11/2007 | |
| EP | 1852541 | A1 * | 11/2007 | D06F 58/203 |
| EP | 1860229 | | 11/2007 | |
| EP | 2390404 | | 11/2011 | |
| EP | 2527518 | | 11/2012 | |
| JP | 2004344238 | | 12/2004 | |

OTHER PUBLICATIONS

International Search Report for International Application No. PCT/EP2013/064498 dated Jun. 3, 2014.
Written Opinion of the International Searching Authority for International Application No. PCT/EP2013/064498 dated Jun. 3, 2014.

* cited by examiner

APPLIANCE FOR DRYING LAUNDRY WITH ENHANCED OPERATION FLEXIBILITY

BACKGROUND OF THE INVENTION

Field of the Invention

The present invention generally relates to the field of household appliances for laundry, clothes and garments treatment. In particular, the present invention relates to appliances for drying laundry, such as laundry dryers and laundry washers also having laundry drying capability.

Discussion of the Related Art

Appliances for drying laundry are adapted to dry clothes, garments, laundry in general, by circulating hot and dry air within a tumbler or drum. The drum is rotatable within a machine external casing or cabinet, and is designed to contain the items to be dried. The rotation of the drum causes agitation (tumbling) of the items to be dried, while they are hit by the drying air flow.

Also known are laundry washer&dryer appliances, which are laundry washers that also have laundry drying capability, thereby combining the functionalities of a laundry washing machine with those of a laundry dryer. In a laundry washer&dryer, the drum is rotatable within a washing tub which is accommodated within a machine external casing or cabinet.

In a known type of laundry dryers and washers&dryers, also referred to as "condenser dryer", the drying air (also referred to as "process air") flow is typically caused to pass through the drum, exiting therefrom from a drying air outlet, then it passes through a moisture condensing system, where the humid, moisture-laden air is at least partially dehydrated, dried, and the dried air flow is heated up by means of a heating arrangement; the heated drying air flow then re-enters into, and passes again through the drum, and repeats the cycle.

While in some known condenser laundry dryers and washers/dryers the moisture condensing system comprises an air-air heat exchanger, exploiting cooling air taken in from the outside the appliance for cooling down the drying air (and thus cause the condensation of the moisture), other known dryers and washers&dryers exploit a heat pump to dehydrate the drying air flow. In these "heat pump dryers", the heating of the drying air may be performed by the heat pump itself. An example of heat pump laundry dryer can be found in EP 2270276.

A fan is provided for promoting the circulation of the process air. The drying air fan is usually coupled to the shaft of the motor that drives the drum, so that the drying air fan is driven along with the drum at a fixed speed.

CH 701466 discloses a clothes dryer in which the volume flow in the drying air circuit is changed within a single drying process: the volume flow is set higher in a starting phase of the drying process than in an end phase thereof, based on a solely time-controlled selection of the volume flow or on a measure of the moisture of the laundry of the drying air using a moisture sensor. The clothes dryer can have a program selection in a known way, via which the user can select one of multiple drying programs having different operating parameters. At least two drying programs are provided, in which the drying air is conveyed using different volume flows (a first drying program generates a lower volume flow than a second drying program).

SUMMARY OF THE INVENTION

The Applicant has observed that a drying air fan that rotates at fixed speed, usually selected in order to avoid excessive airborne noise in the appliance, causes the drying air flow rate to be kept limited to attain a level of noise that is considered acceptable.

However, the drying air flow rate that results from such a noise level constraint is often far from being the best under the viewpoint of the drying performance, in terms of energy saving and drying time, which could be drastically reduced by having higher drying air flow rates.

The Applicant has found that establishing a priori a level of noise to be considered acceptable, and designing the drying air flow rate to comply with such acceptable noise level established a priori, jeopardizing the drying performance, is not the best approach.

The noise level that is to be considered "acceptable" may vary depending on several factors, like the time of the day, the user premises, the tolerance of the user to noise, etc.

The Applicant believes that the solution described in CH 701466 is not sufficiently flexible: essentially, in CH 701466 either the clothes dryer automatically switches the drying air volume flow to a lower rate after a certain time has lapsed from the start of a drying process (without the user being able to decide whether and/or when to switch), or an additional drying program is provided having a reduced drying air volume flow.

The Applicant has faced the problem of devising an appliance for drying laundry which is more flexible in terms of choices made available to the user for the selection of laundry treatment cycles, particularly laundry drying cycles.

The Applicant has found that a solution to the above mentioned problem can be achieved by causing the drying air fan (or drying air propeller means) to be operable at variable speeds, in response to a selection made by the user through a dedicated command input means provided on the appliance.

According to an aspect of the present invention, there is provided an appliance for drying laundry comprising an appliance cabinet, a laundry treatment chamber inside the cabinet, a drying air recirculation path for causing recirculation of the drying air into/out from the laundry treatment chamber, a drying air propeller driven by a drying air propeller motor for causing the drying air to recirculate along the drying air recirculation path, a drying air moisture condensing and heating system located in the drying air recirculation path for dehydrating the moisture-laden drying air leaving the laundry treatment chamber and heating the dehydrated drying air before it re-enters into the laundry treatment chamber.

The appliance comprises a user interface comprising a laundry drying cycle selector operable by a user for selecting one out of a number of default laundry drying cycles, and a control unit adapted to control the machine operation, said controlling the machine operation comprising commanding the drying propeller motor to work at a default average speed corresponding to the selected drying cycle.

The user interface comprises a command input means operable by the user for imparting to the appliance a command by which the control unit cause a change in an average working speed of the drying air propeller motor with respect to a default drying air propeller motor average working speed corresponding to the selected laundry drying cycle.

Said changing an average working speed of the drying air propeller motor with respect to a default drying air propeller motor average working speed may comprise increasing an average working speed of the drying air propeller motor with respect to the default drying air propeller motor average working speed.

In embodiments of the present invention, said drying air moisture condensing and heating system may comprise a heat pump operating with a refrigerant fluid, wherein said heat pump comprises a refrigerant fluid compressor, a first heat exchanger, for heating the drying air by having the refrigerant fluid release heat, a second heat exchanger, for cooling the drying air by transferring heat to the refrigerant fluid, a refrigerant fluid expansion device.

Said compressor may be a fixed-speed refrigerant fluid compressor, or a variable-speed refrigerant fluid compressor, in which case by acting on said command input means the user may impart to the appliance a command for changing the average working speed of the drying air propeller motor irrespective of any change in the refrigerant fluid compressor speed.

The appliance may comprise a compressor cooling fan arranged for cooling the refrigerant fluid compressor. The control unit may control the compressor cooling fan based on a detected refrigerant fluid temperature, and when the user imparts the command through the command input means the control unit may change a default limit refrigerant fluid temperature so as to change an activation period of the compressor cooling fan and/or a speed of the compressor cooling fan.

The heat pump comprises a high-pressure refrigerant fluid circuit portion, extending from an outlet of the refrigerant fluid compressor via the first heat exchanger to an inlet of the expansion device, and a low-pressure refrigerant fluid circuit portion, extending from an outlet of the expansion device via the second heat exchanger to the inlet of the refrigerant fluid compressor. At least one additional heat exchanger may be provided in the refrigerant fluid circuit, along the high-pressure refrigerant fluid circuit portion and/or the low-pressure refrigerant fluid circuit portion.

In other embodiments of the present invention, the drying air moisture condensing and heating system may comprise an air-air heat exchanger.

Said command input means may comprise a pushbutton or a touchbutton on a touch screen, said pushbutton or touchbutton being distinct from the drying cycle selector.

Preferably, the laundry treatment chamber comprises a rotatable drum caused to rotate by a drum motor. Said drying air propeller motor and said drum motor may be a selfsame motor, in which case said increasing the average working speed of the drying air propeller motor with respect to the default drying air propeller motor average working speed preferably comprises not exceeding an average drum rotation speed that may cause laundry to get stuck on the drum inner walls.

Alternatively, the drying air propeller motor is distinct and distinctly operated with respect to said drum motor.

Advantageously, the user interface comprises display means for displaying relevant information to the user, and when the control unit receives the user command imparted by the user through the command input means, the control unit causes the appliance to give a confirmation to the user by displaying on the display means an indication.

The user interface may also comprise acoustic means, and when the control unit receives the user command imparted by the user through the command input means, the control unit causes the appliance to give a confirmation to the user by causing the acoustic means emit an acoustic signal.

Said command input means may be configured so as to allow the user to select more than one different average working speeds for the drying air propeller.

Possibly, said change in the average working speed depends on the selected laundry drying cycle.

BRIEF DESCRIPTION OF THE DRAWINGS

These and other features and advantages of the present invention will be better understood by reading the following detailed description of some embodiments thereof, provided merely by way of non-limitative examples, description that, for its better intelligibility, should be read in conjunction with the attached drawings, wherein.

DETAILED DESCRIPTION OF EMBODIMENTS OF THE INVENTION

Figure 1:
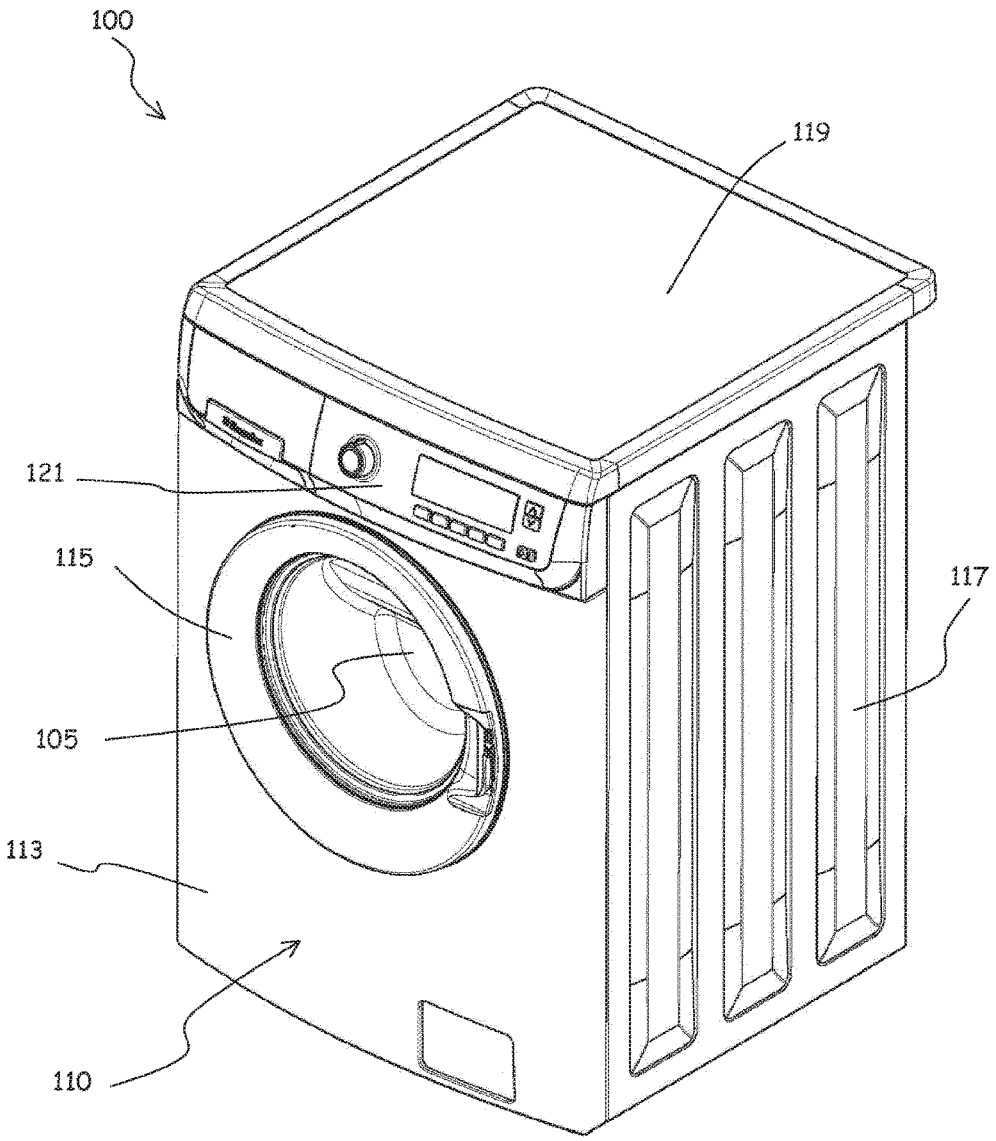
FIG. 1 is a perspective view from the front of an appliance for drying laundry according to an embodiment of the present invention.

With reference to the drawings, a laundry drying appliance according to an embodiment of the present invention, for example a laundry dryer or a laundry washer&dryer, is depicted in FIG. 1 in perspective from the front. The laundry drying appliance, globally denoted as 100, comprises a laundry treatment chamber 105 for accommodating the items to be dried or washed and dried, such as clothes, garments, linen, and similar laundry items. Preferably the laundry treatment chamber 105 includes a drum rotatably mounted inside the machine casing or cabinet 110, and in case the appliance is a laundry washer&dryer the drum is arranged within a tub housed in the machine casing or cabinet 110. The drum is not visible in FIG. 1, being inside the cabinet 110, but in FIGS. 2-5 the drum is schematically depicted, and denoted 200.

The cabinet 110 is generically a parallelepiped in shape, and has a front wall 113, two side walls 117, a rear wall, a basement and a top 119. The front wall 113 is provided with an opening for accessing the laundry treatment chamber 105 and loading/unloading the laundry, and a door 115 is hinged to the front wall 113 for closing the loading/unloading opening. In the upper part of the front wall 113, an appliance control panel (user interface) 121 is located. The top 119 closes the cabinet 110 from above, and may also define a worktop.

In the laundry drying appliance 100, in order to dry laundry, drying air (process air) is caused to flow through the laundry treatment chamber 105, where the items to be dried are contained, and; in the preferred case the laundry treatment chamber 105 includes the rotatable drum 200, the items to be dried are caused to tumble by the drum rotation. After exiting the laundry treatment chamber 105, the flow of moisture-laden drying air passes through a moisture condensing system, where the humid, moisture-laden drying air is (at least partially) dried, dehydrated. The dehydrated air flow is then heated and caused to pass again through the laundry treatment chamber 105, repeating the cycle.

The schematic drawings of FIGS. 2-5 show some of the components of the laundry drying appliance 100 which are useful for understanding the invention embodiments described herein by way of example.

Figure 2:
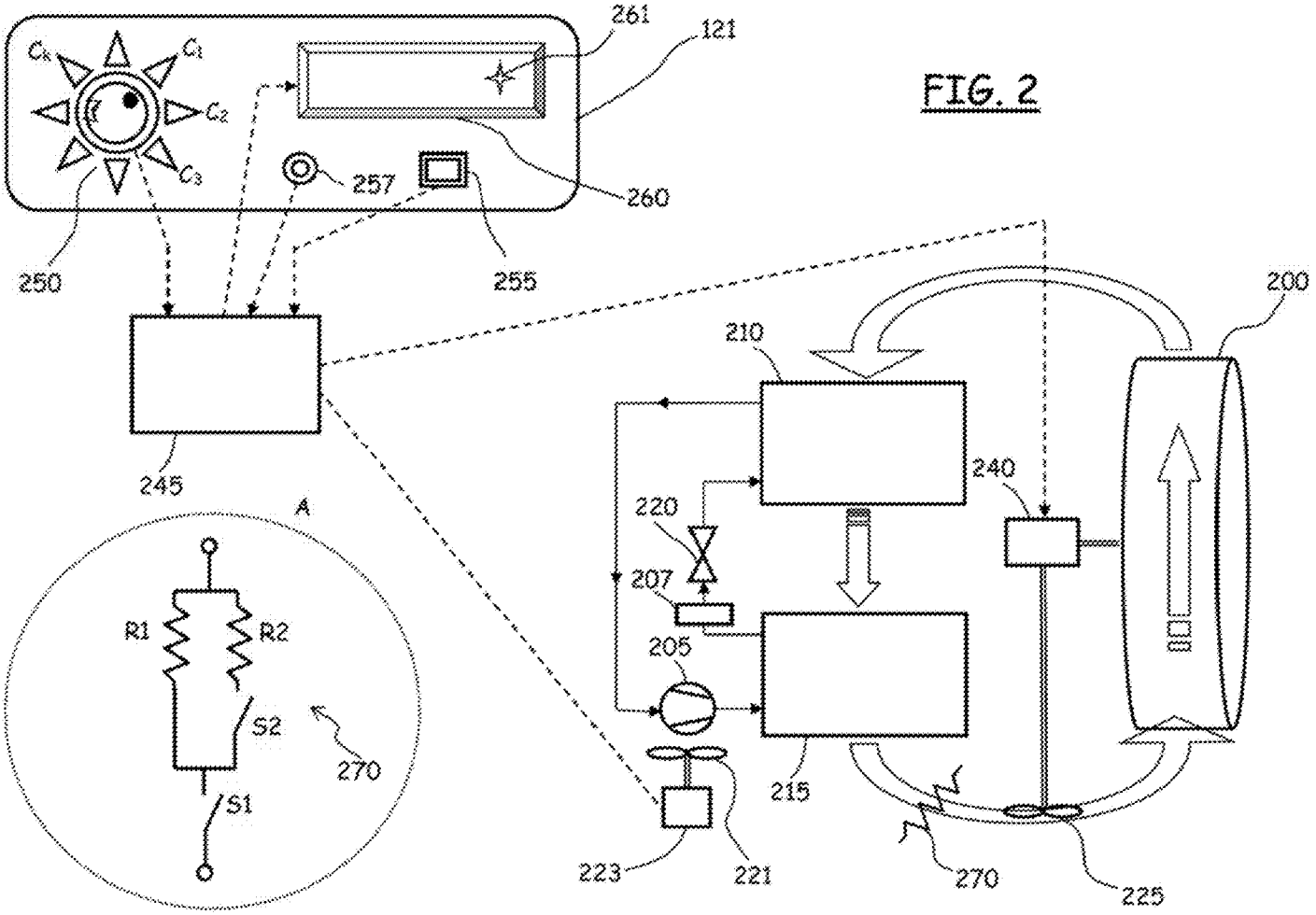
FIG. 2 schematically shows an arrangement of relevant components of the appliance according to an embodiment of the present invention.
Figure 3:
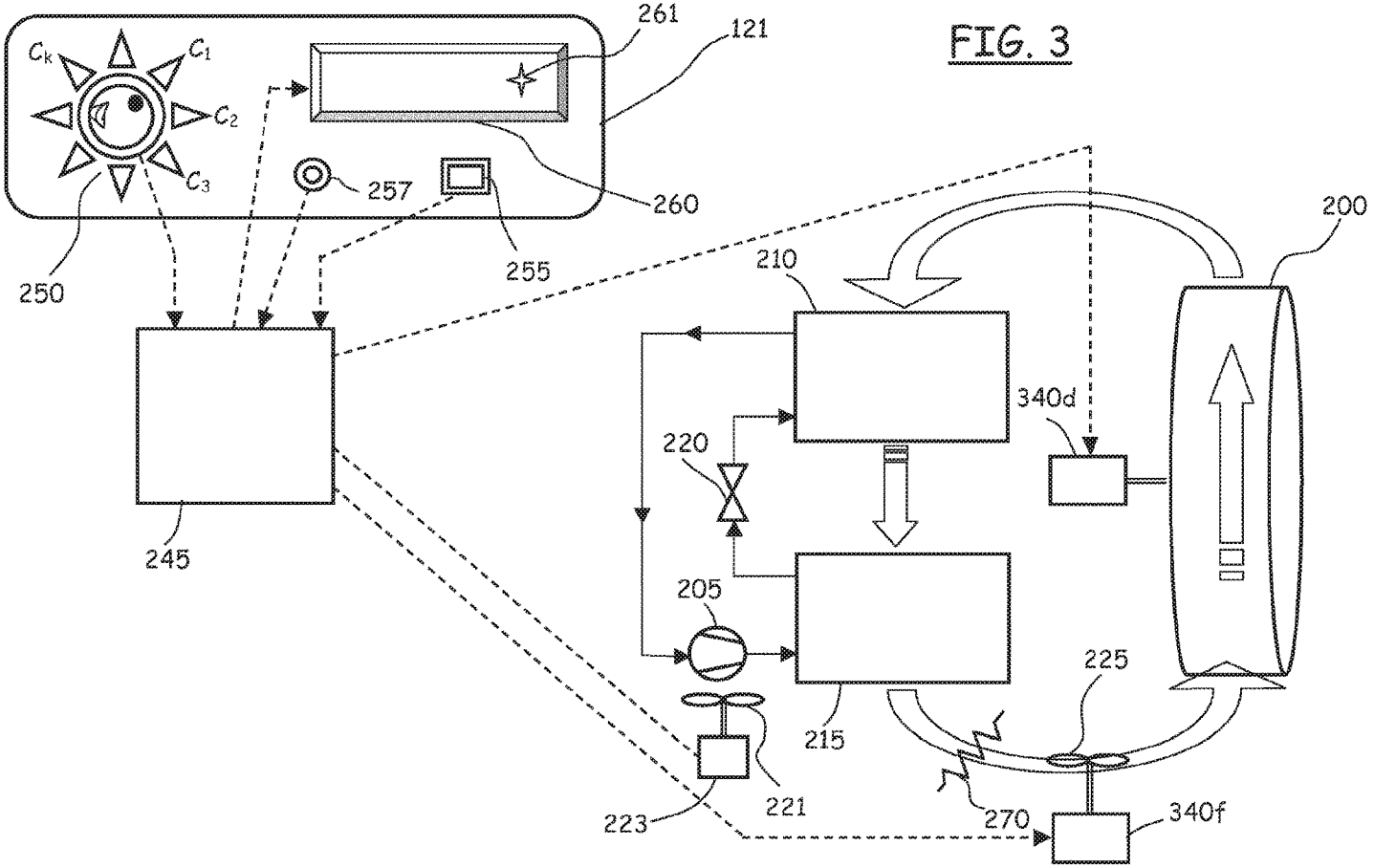
FIG. 3 schematically shows another arrangement of relevant components of the appliance according to another embodiment of the present invention.

The embodiments of FIGS. 2 and 3 refer to a laundry drying appliance 100 that has a moisture condensing system comprising a heat pump operating with a refrigerant fluid. The embodiments of FIGS. 4 and 5 refer to a laundry drying appliance 100 that has a moisture condensing system comprising an air-air heat exchanger.

Referring to FIG. 2 the heat pump comprises a refrigerant fluid circuit. The refrigerant fluid circuit comprises a refrigerant fluid compressor 205; a first heat exchanger 215, e.g. a refrigerant fluid liquefier, for heating the drying air by having the refrigerant fluid release heat; a second heat exchanger 210, e.g. a refrigerant fluid evaporator, for cooling the drying air by transferring heat to the refrigerant fluid. The refrigerant fluid, after exiting the first heat exchanger 215 and before entering the second heat exchanger 210, passes through a refrigerant fluid expansion device 220 (e.g., capillary tube, expansion valve). The refrigerant fluid circuit of the heat pump is subdivided in a high pressure portion and a low pressure portion: the high pressure portion extends from the outlet of the compressor 205 via the first heat exchanger 215 to the inlet of the expansion device 220, whereas the low pressure portion extends from the outlet of the expansion device 220 via the second heat exchanger 210 to the inlet of the compressor 205. Additional heat exchangers 207 can be provided in the refrigerant fluid circuit, along the high pressure portion and/or the low pressure portion. As illustrated in FIG. 2, an additional heat exchanger 207 is located along the high pressure portion of the refrigerant fluid circuit.

The compressor 205 can be a fixed-speed compressor or a variable-speed compressor. A compressor cooling fan 221 is preferably provided for cooling the compressor 205. The compressor cooling fan 221 can be driven by a dedicated motor 223. The motor 223, e.g. an electric motor, can be a fixed-speed motor or a variable-speed motor, capable of operating at different speeds.

The thick arrows in FIG. 2 schematize the drying air recirculation path. The drying air is propelled by a drying air propeller 225, that causes the drying air to pass through the drum 200 where the items to be dried are contained. In the drum 200, the drying air subtracts moisture from the items to be dried and becomes moisture-laden. After exiting the drum 200, the moisture-laden drying air passes through the second heat exchanger 210, where the drying air is cooled down and dehydrated by releasing moisture. Then the dehydrated drying air passes through the first heat exchanger 215, where the drying air is heated up. Thereafter, the heated drying air enters again into the drum 200.

A Joule-effect drying air heater 270, for example one (or, possibly, more than one) electric resistor can be provided in the drying-air recirculation path, being for example arranged downstream the first heat exchanger 215, for boosting the drying air heating, e.g. during an initial transitory part of a drying cycle, during which the drying air temperature and the refrigerant fluid temperature are increased up to respective operating levels (after the initial transitory part of a drying cycle, the Joule-effect drying air heater 270 is preferably deactivated). As schematized in the detail A of FIG. 2, the Joule-effect drying air heater 270 can comprise two heating resistors R1 and R2, selectively energizable by means of switches S1 and S2: switch S1 can be kept closed during said initial transitory part of the drying cycle, so as to keep resistor R1 energized. Switch S2 can be intermittently switched closed and open, to keep the drying air temperature regulated. For example, a drying air temperature sensor or probe can be provided in the drying-air recirculation path, for example downstream the Joule-effect drying air heater 270, preferably where the drying-air recirculation path opens into the laundry treatment chamber 105, at the inlet thereof, for sensing the drying-air temperature before it enters into the laundry treatment chamber.

In the embodiment of FIG. 2, a single motor 240 (e.g., an electric motor) is provided for driving both the drum 200 and the drying air propeller 225. Advantageously, the motor 240 is a variable-speed motor, capable of operating at different speeds. In an embodiment of the present invention, the motor 240 is an inverter electric motor.

Block 245 schematizes an appliance control unit, for example an electronic control board, which governs the appliance operation, and inter alia controls the drum and drying air propeller motor 240, the compressor cooling fan motor 223 (so as to control the activation and/or speed of the compressor cooling fan 221 in dependence of the temperature of the refrigerant fluid. sensed for example at the inlet of the expansion device 220), possibly the speed of the compressor 205 (if the latter is a variable-speed compressor), the Joule-effect drying air heater 270 (i.e., the switches S1 and S2), and which receives the drying air temperature readings from the drying air temperature probe.

The control unit 245 may be a programmable electronic control unit, for example comprising a microcontroller or a microprocessor, which is adapted to execute a program stored in a program memory thereof.

The control unit 245 receives inputs from the control panel (user interface) 121, by means of which the user may e.g. set the desired laundry drying program or cycle, as well as set options for the operation of the machine.

The control panel 121 comprises a laundry drying cycle selector 250, e.g. a rotary selector, through which the user can select a desired laundry drying cycle out of a number of pre-defined, default laundry drying cycles $C_1$, $C_2$, $C_3$, . . . , $C_k$. The generic default laundry drying cycle is characterized by certain respective default parameters, and particularly by a certain default speed (default average speed, averaged over time) of the motor 240 (and, consequently, of the drying air propeller 225). For example, all the default drying cycles are characterized by a(n average) value of drying air propeller rotation speed that the appliance designer has selected based on a trade-off between the appliance performance and an appliance noise level requirement, such that the level of the noise produced by the appliance is not above a noise level that is regarded by the designer as admissible, tolerable. Average speed is hereby also referred to, because during a generic drying cycle $C_1$, $C_2$, $C_3$, . . . , $C_k$ the speed of the motor 240 can be caused to oscillate around an average speed value, to facilitate the drying of the laundry.

The control panel 121 further comprises user command input means 255, preferably distinct from said laundry treatment cycle selector 250, through which the user is allowed to command the control unit 245 to change the default rotation speed of the drying air propeller 225, as described in detail in the following. The user command input means 255 comprise for example a pushbutton or slider or rotary knob, either physical or virtual.

The control panel 121 also comprises a cycle start button (a pushbutton or a touchbutton) 257, the user can push to start the machine operation.

The control panel 121 preferably comprises display means 260 for displaying to the user relevant or useful information about the appliance settings and operation. The display means 260 may comprise a touch screen, and the virtual user command input means 255 may be a displayed icon defining a touchbutton. In the case of a touch screen, also the laundry drying cycle selector 250 and/or the cycle start button 257 can be virtual, touch buttons displayed on the display means 260.

Figure 6:
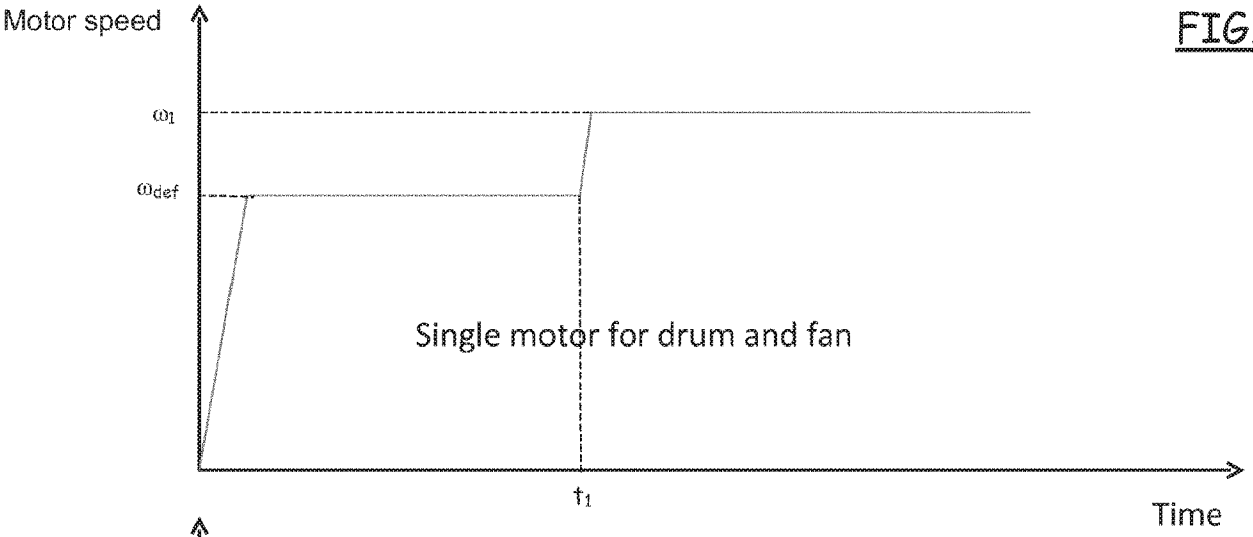
FIG. 6 is a time diagram of an exemplary drying air propeller speed course, and drum rotation speed course, for the embodiments of FIGS. 2 and 4.

Referring to FIG. 6, in operation the user puts the laundry to be dried in the drum 200, closes the door 115, then through the laundry drying cycle selector 250 selects a desired one of the default laundry drying cycles $C_1$, $C_2$, $C_3$, . . . , $C_k$ for example according to the nature of the textiles to be treated, and push the start button 257 to start the appliance 100. The appliance starts performing the default drying cycle selected by the user under the control of the control unit 245, which, among other things, commands the drum and drying air propeller motor 240 to work at the default rotation speed $\omega_{def}$.

At any time during the ongoing drying cycle, as well as possibly from the very beginning (e.g., before starting the appliance), or after a while the execution of the drying cycle has begun, e.g. at instant the user may decide to change the speed of the drying air propeller 225, for example to increase the drying air propeller speed to a value $\omega_1$, for example the maximum allowed speed for the motor 240 (as discussed shortly hereafter), so as to increase the drying air flow rate for reducing the laundry drying time. To do so, the user acts on the user command input means 255: in response, the control unit 245 commands the drum and drying air propeller motor 240 to work at an increased rotation speed $\omega_1$ higher than the default rotation speed $\omega_{def}$. In this way, both the drying air propeller 225 and the drum 200 are caused to rotate faster than the default speed. Faster rotation of the drying air propeller 225 increases the drying air flow rate and consequently reduces the drying time; faster rotation of the drum 200, although being a consequence of having just a single motor 240, is of no detriment: experimental tests have shown that there are no relevant negative effects due to the laundry sticking on the drum surface as long as the drum rotation speed is kept below approximately 80 RPM. Preferably, when the control unit 245 receives the user command to change the drying air propeller speed, the control unit 245 causes the appliance to give a confirmation to the user, e.g. by displaying on the display means 260 an indication or an icon 261 (and/or by lighting a dedicated light provided on the control panel 121, and/or by emitting an acoustic signal, e.g. a buzz). The user needs not to be aware of the fact that, by acting on the command input means 255, a different drying air propeller speed is set: he/she is for example just aware of the fact that the command input means 255 correspond to a "fast drying cycle" selection, and that by selecting such option the appliance can execute any one of the default drying cycles faster, possibly with an increased noise level.

The increased drying air flow rate also helps the heat pump reaching a higher efficiency working point than that reached with the default drying air flow rate.

In case the heat pump compressor 205 is a variable-speed compressor, whose speed is controllable by the control unit 245, the change (e.g., increase) of the drying air propeller speed consequent to the user command however takes place irrespective of the compressor speed (which can remain unchanged), i.e. the control unit 245 controls the drying air propeller speed and the compressor speed disjointly.

Overall, by increasing the drying air flow rate, not only is the drying time reduced, also a saving of electric power is achieved, especially in a heat pump dryer (thanks to the enhanced exchange of heat in the heat exchangers).

As mentioned above, the control unit 245 preferably activates the Joule-effect drying air heater 270 in the initial phases of a drying cycle, when the heat pump has not yet reached its proper working point, to assist the heating of the drying air. Advantageously, when the user imparts the command through the command input means 255 to change, e.g. increase the drying air propeller speed, the control unit 245 may command the Joule-effect drying air heater 270 to stay activated for a prolonged period of time, to boost the drying air heating, and thus contributing to the reduction of the drying time.

As mentioned in the foregoing, the control unit 245 controls the compressor cooling fan motor 223 so as to control the activation and/or the speed of the compressor cooling fan 221 (this latter in the case the motor 223 is a variable-speed motor). The control unit 245 bases the control of the motor 223 on the refrigerant fluid temperature detected for example at the inlet of the expansion device 220, so as to keep the refrigerant fluid temperature below 65° C. When the user imparts the command through the command input means 255 to change, e.g. increase, the drying air propeller speed, the control unit 245 may change the set limit refrigerant fluid temperature, e.g. increasing it from 65° C. to 75° C., so that the activation period of the compressor cooling fan 221, and/or the speed of the compressor cooling fan 221, is/are reduced.

The increased rotation speed $\omega_1$ can be maintained for the whole remaining part of the drying cycle after the user has imparted the command through the command input means 255 (which command, as mentioned in the foregoing, can be imparted at any time during the ongoing drying cycle, as well as possibly from the very beginning, e.g., before starting the appliance, or after a while the execution of the drying cycle has begun, e.g. at the instant ti), or for at least a fraction of the remaining part of the drying cycle. For example, the control unit 245 may command the drum and drying air propeller motor 240 to return to the default rotation speed $\omega_{def}$ when, after the laundry has been dryed, the heat pump (i.e., the compressor 205) is deactivated.

Figure 8:
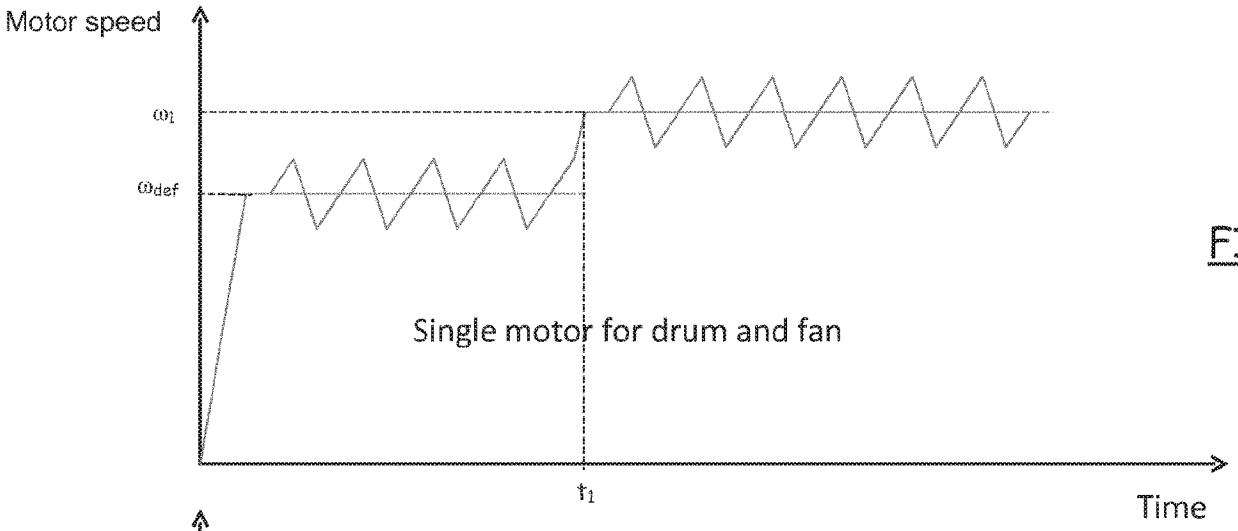
FIG. 8 is a time diagram of another exemplary drying air propeller speed course, and drum rotation speed course, for the embodiments of FIGS. 2 and 4.

As schematized in FIG. 8, the change, e.g. increase, in the working speed of the motor 240 that drives both the drum 200 and the drying air propeller 225 is compatible with an oscillation of the working speed of motor 240 around an average value, i.e. the command imparted by the user through the command input means 155 causes a change, e.g. an increase in the average value of the motor 240 working speed: the average value of the motor 240 working speed over the time period after the control unit 245 has commanded the drum and drying air propeller motor 240 to increase the rotation speed is different, e.g. higher than the average value of the motor 240 working speed over the time period before the control unit 245 has commanded the increase of the rotation speed. Similarly, the change, e.g. increase, in the (average) working speed of the motor 240 is also compatible with a periodical reversal in the rotation sense of the drum 200, which is beneficial for enhancing the tumbling of the laundry to be dried, for making the drying of the laundry more uniform.

The appliance 100 can be configured so that, through the command input means 255, the user is allowed to select more than one, e.g. two or more, different (average) speeds for the drying air propeller 225. For example, it may be provided that by pushing the command input means (pushbutton) 225 once, the user selects a first increased drying air propeller (average) speed, higher than the default (average) speed; by pushing the pushing the command input means (pushbutton) 225 twice, the user selects a second increased drying air propeller (average) speed, higher than the first increased (average) speed, etc. Alternatively, the command input means may comprise two or more pushbuttons, the actuation of either of which causes a different increase in the drying air propeller (average) speed over the default (average) speed. The current drying air propeller (average) speed corresponding to the user selection can be signaled to the user on the display means 260, e.g. by means of an indicator bar like a bar with segments that are selectively highlighted.

Figure 7:
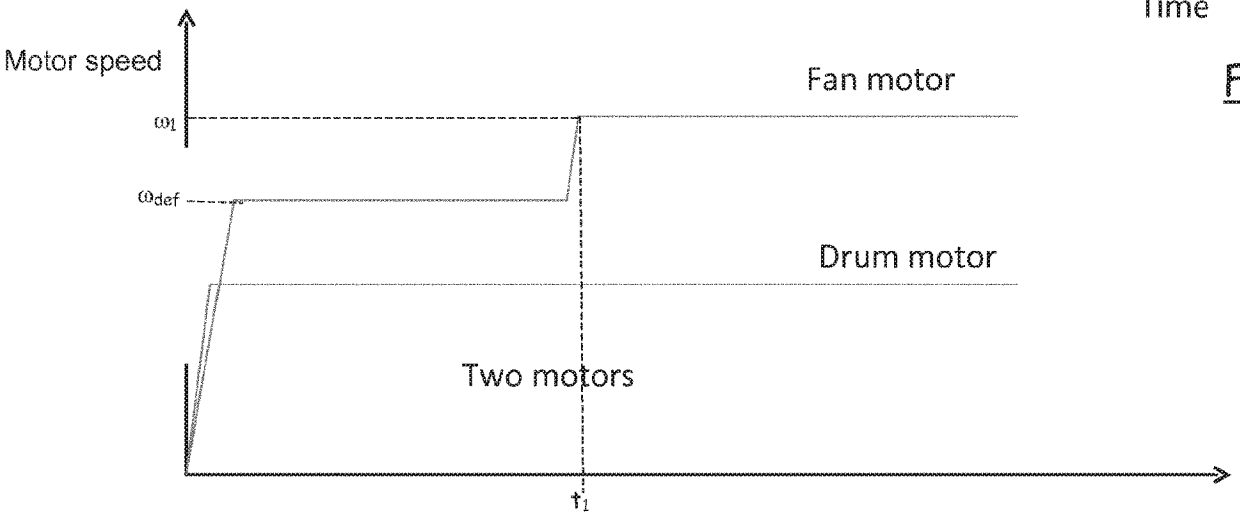
FIG. 7 is a time of an exemplary drying air propeller speed course, and drum rotation speed course, for the embodiments of FIGS. 3 and 5.
Figure 9:
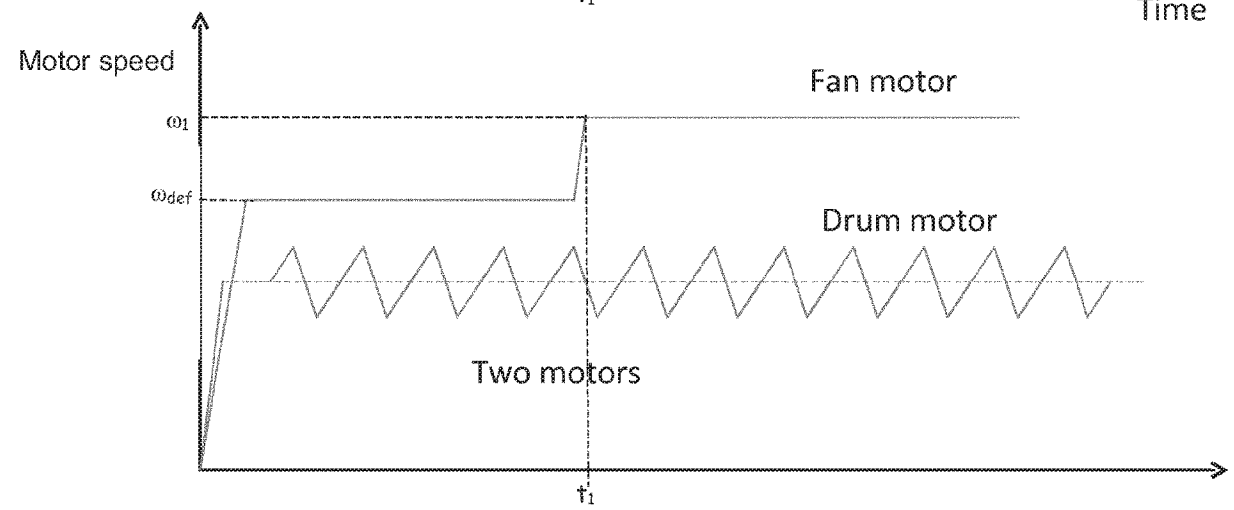
FIG. 9 is a time of another exemplary drying air propeller speed course, and drum rotation speed course, for the embodiments of FIGS. 3 and 5.

The embodiment schematized in FIG. 3 is similar to that of FIG. 2, with the difference that instead of a single motor 240 for driving both the drum 200 and the drying air propeller 225, two distinct motors 340*d*, for driving the drum 200, and 340*f*, for driving the drying air propeller 225 are provided. In such a case, then the control unit 245, upon receiving from the user the command to change, e.g. increase the drying air propeller speed, commands to the drying air propeller motor 340*f* to increase its working speed, without affecting the drum rotation speed. The behavior of the drum and drying air propeller is schematized in FIG. 7 and FIG. 9 (the latter refers to the case in which during the execution of the drying cycle there is an oscillation of the rotation speed of the drum around an average rotation speed: differently from the embodiment of FIG. 2, thanks to the presence of two distinct motors 340*d* and 340*f*, no oscillation of the drying air propeller rotation speed takes place even in case the drum rotation speed oscillates, and the same holds true in case during the drying cycle the drum rotation sense is periodically reversed).

The provision of a dedicated motor 340*f* for driving the drying air propeller 225, distinct from the drum motor 340*d* enhances the flexibility of the appliance. For example, in such a case the drying air propeller 225 rotation speed has not to be limited by concerns of laundry getting stuck on the drum walls.

Figure 4:
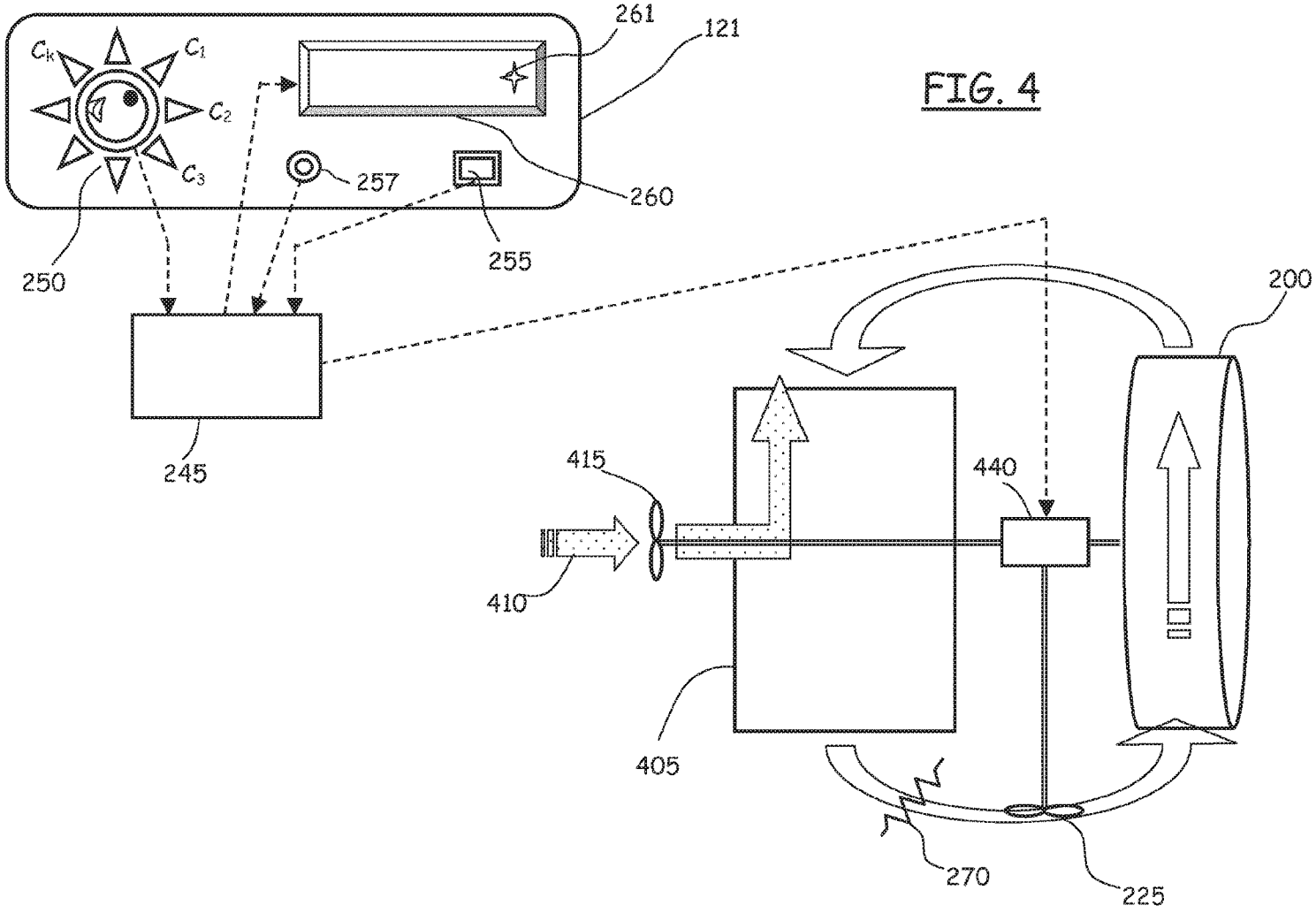
FIG. 4 schematically shows another arrangement of relevant components of the appliance according to another embodiment of the present invention.
Figure 5:
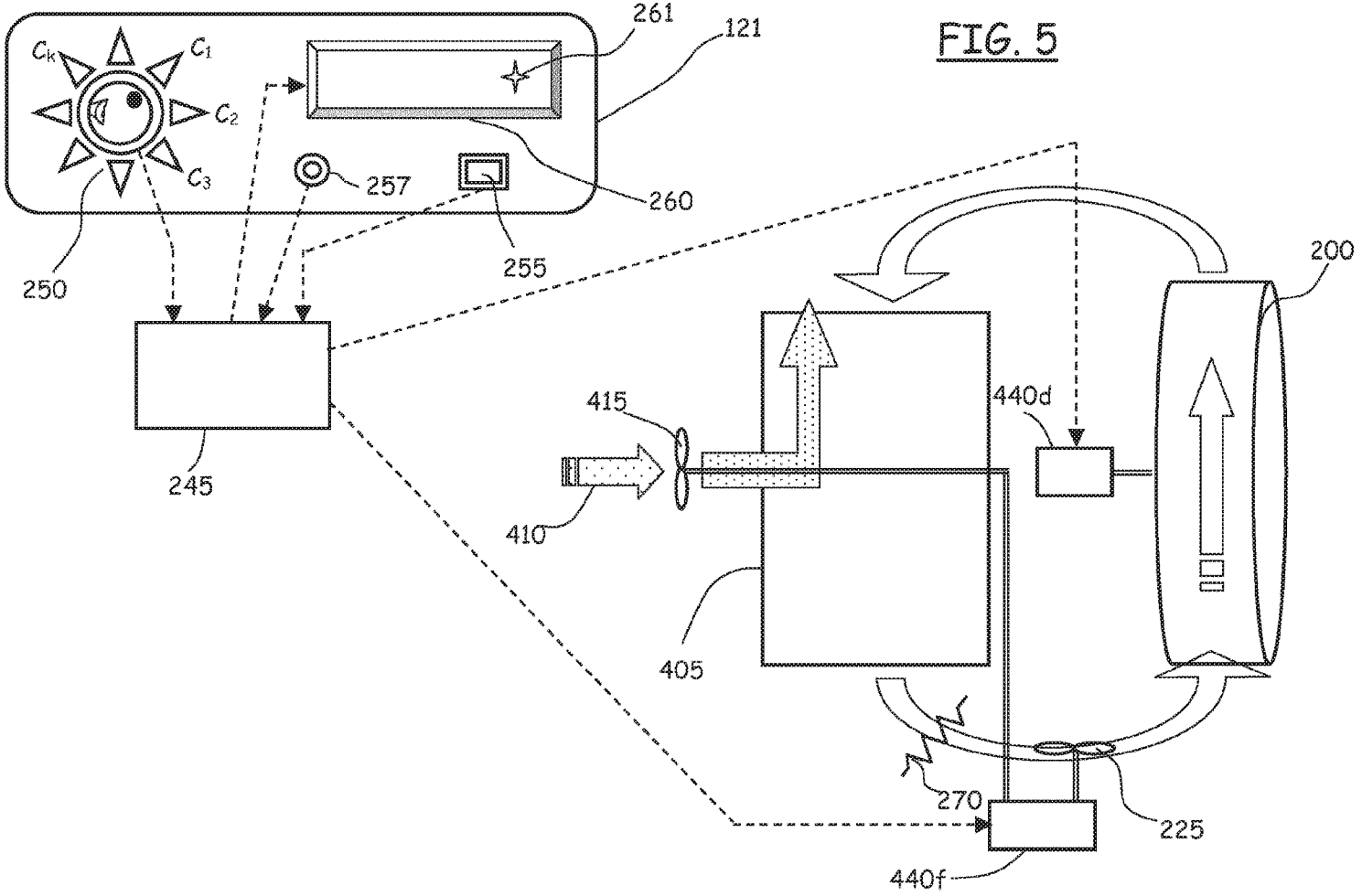
FIG. 5 schematically shows still another arrangement of relevant components of the appliance according to another embodiment of the present invention.

The embodiments of FIGS. 4 and 5 correspond to the embodiments of FIGS. 2 and 3, respectively, but relate to a laundry drying appliance having a moisture condensing system that, instead of a heat pump, comprises an air-air heat exchanger 405 exploiting cooling air 410 taken in from outside the appliance (ambient air) for cooling down the drying air and cause the condensation of the moisture (in the drawings, the cooling air is depicted as thick arrows filled with dots). For taking in and propelling the cooling air 410, a fan 415 is provided. The Joule-effect drying air heater 270 (for example comprising one or more electric resistors) is provided in the drying-air recirculation path for heating the drying air after the latter has been dehydrated.

As already described in connection with FIG. 2, the Joule-effect drying air heater 270 can comprise the two heating resistors R1 and R2, selectively energizable by means of the switches S1 and S2, where the switch S1 can be kept closed during the whole drying cycle (or the majority of the drying cycle), so as to keep resistor R1 energized, while switch S2 can be intermittently switched closed and open, to keep the drying air temperature regulated. In case/when the user imparts the command through the command input means 255, the control unit 245 may increase the duty cycle of the switch S2, so as to keep resistor R2 energized for longer time.

In the embodiment of FIG. 4, a single motor 440 is provided for driving the drum 200, the drying air propeller 225 and the cooling air fan 415. In the embodiment of FIG. 5, the drum 200 from one side and the drying air propeller 225 and cooling air fan 415 from the other side have each a respective driving motor 440*d* and 440*f*.

When the user, through the command input means 255, imparts the command to change, e.g. increase the drying air propeller speed, the cooling air fan speed is also increased, so that an increased cooling air flow rate is achieved, which further improves the performance of the appliance in terms of drying time reduction.

Thanks to the solution disclosed herein, the laundry drying appliance has an improved operation flexibility, that allows the appliance user to decide whether to vary the laundry drying time irrespective of design constraints that are e.g. focused on the level of noise generated by the appliance while working.

In embodiments of the present invention, the change, e.g. increase in the (average) speed of the drying air propeller commanded by the control unit upon receiving the user command may differ depending on the default laundry drying cycle selected by the user/being executed by the appliance, for example for taking into account that different default drying cycles are designed for different types of textiles. Also, the change, e.g. increase in the (average) speed of the drying air propeller may be inhibited by the control unit if the user has selected certain drying cycles (which are designed for types of textiles which are not compatible with an increase in the drying air propeller speed).

Nothing prevents that, in alternative embodiments of the invention, the command input means 255 are a peculiar position (physical or virtual) of the drying cycle selector 250 that is interpreted by the control unit 245 as meaning that the user wants that a generic one of the default laundry drying cycles $C_1, C_2, C_3, \ldots, C_k$ is executed with a drying air propeller 225 (average) working speed different from the default (average) working speed specified for that drying cycle. Also, in other embodiments of the invention, an additional laundry drying cycle may be provided, in addition to the default laundry drying cycles $C_1, C_2, C_3, \ldots, C_k$, by selecting which the user can command the appliance to work at a drying propeller speed different, particularly higher than the noise-limited drying air propeller speed of the default drying cycles.

The invention claimed is:

1. An appliance for drying laundry, the appliance comprising:

an appliance cabinet;

a laundry treatment chamber inside the cabinet;

a drying air recirculation path for conveying drying air into/out from the laundry treatment chamber;

a drying air propeller motor;

a drying air propeller driven by the drying air propeller motor for causing the drying air to recirculate along the drying air recirculation path;

a drying air moisture condensing and heating system located in the drying air recirculation path and configured to dehydrate the moisture-laden drying air leaving the laundry treatment chamber and heat the dehydrated drying air before it re-enters into the laundry treatment chamber;

a laundry drying cycle selector operable by a user for selecting among a number of default laundry drying cycles;

a control unit configured to control the machine operation by commanding the drying propeller to work at a default average speed corresponding to a selected laundry drying cycle;

a command input operable by the user during the selected laundry drying cycle to cause the control unit to change, during the selected laundry drying cycle, an average working speed of the drying air propeller with respect to the default average speed corresponding to the selected laundry drying cycle, wherein the command input is operable to cause the control unit to increase the average working speed of the drying air propeller with respect to the default average speed corresponding to the selected laundry drying cycle.

2. The appliance of claim 1, wherein:

the drying air moisture condensing and heating system comprises a heat pump operating with a refrigerant fluid, and wherein the heat pump comprises:

a refrigerant fluid compressor, a first heat exchanger for heating the drying air with heat released from the refrigerant, a second heat exchanger for cooling the drying air by transferring heat to the refrigerant fluid, and a refrigerant fluid expansion device.

3. The appliance of claim 2, wherein the refrigerant fluid compressor is a fixed-speed refrigerant fluid compressor.

4. The appliance of claim 2, further comprising a compressor cooling fan arranged for cooling the refrigerant fluid compressor, and wherein:

the control unit is configured to control the compressor cooling fan based on a detected refrigerant fluid temperature; and the control unit is operable to change a default limit refrigerant fluid temperature so as to change an activation period of the compressor cooling fan and/or a speed of the compressor cooling fan when the command input is operated.

5. The appliance of claim 2, wherein:

the heat pump comprises a first refrigerant fluid circuit portion, extending from an outlet of the refrigerant fluid compressor via the first heat exchanger to an inlet of the refrigerant fluid expansion device, and a second refrigerant fluid circuit portion, extending from an outlet of the refrigerant fluid expansion device via the second heat exchanger to the inlet of the refrigerant fluid compressor; and at least one additional heat exchanger is provided along the first refrigerant fluid circuit portion and/or the second refrigerant fluid circuit portion.

6. The appliance of claim 1, wherein the drying air moisture condensing and heating system comprises an air-air heat exchanger.

7. The appliance of claim 1, wherein the command input comprises a pushbutton or a touchbutton on a touch screen, the pushbutton or touchbutton being distinct from the laundry drying cycle selector.

8. The appliance of claim 1, wherein the laundry treatment chamber comprises a rotatable drum caused to rotate by a drum motor, and wherein the drying air propeller motor and the drum motor are the same motor.

9. The appliance of claim 8, wherein:

the command input is operable to cause the control unit to increase the average working speed of the drying air propeller with respect to the default average speed corresponding to the selected laundry drying cycle without exceeding a predetermined average drum rotation speed associated with laundry becoming stuck on an inner wall of the rotatable drum.

10. The appliance of claim 1, wherein the laundry treatment chamber comprises a rotatable drum caused to rotate by a drum motor, and wherein the drying air propeller motor is distinct from and distinctly operated with respect to the drum motor.

11. The appliance of claim 1, further comprising a user interface configured to provide operation information to the user, and configured to provide an indication when the command input has been operated by the user.

12. The appliance of claim 11, wherein the user interface comprises an audible indicator that is activated to emit an audible signal when the command input has been operated by the user.

13. The appliance of claim 1, wherein the command input is configured to allow the user to select more than one different average working speeds for the drying air propeller.

14. The appliance of claim 1, wherein the change in the average working speed depends on the selected laundry drying cycle.

15. The appliance of claim 1, wherein changing an average working speed of the drying air propeller with respect to the default average speed corresponding to the selected laundry drying cycle comprises changing an operating speed of the drying air propeller motor.

16. An appliance for drying laundry, the appliance comprising:

an appliance cabinet;

a laundry treatment chamber inside the cabinet;

a drying air recirculation path for conveying drying air into/out from the laundry treatment chamber;

a drying air propeller motor;

a drying air propeller driven by the drying air propeller motor for causing the drying air to recirculate along the drying air recirculation path;

a drying air moisture condensing and heating system located in the drying air recirculation path and configured to dehydrate the moisture-laden drying air leaving the laundry treatment chamber and heat the dehydrated drying air before it re-enters into the laundry treatment chamber;

a laundry drying cycle selector operable by a user for selecting among a number of default laundry drying cycles;

a control unit configured to control the machine operation by commanding the drying propeller to work at a default average speed corresponding to a selected laundry drying cycle;

a command input operable by the user during the selected laundry drying cycle to cause the control unit to change, during the selected laundry drying cycle, an average working speed of the drying air propeller with respect to the default average speed corresponding to the selected laundry drying cycle, wherein:

the drying air moisture condensing and heating system comprises a heat pump operating with a refrigerant fluid, and wherein the heat pump comprises:

a refrigerant fluid compressor, a first heat exchanger for heating the drying air with heat released from the refrigerant, a second heat exchanger for cooling the drying air by transferring heat to the refrigerant fluid, and a refrigerant fluid expansion device, wherein:

the refrigerant fluid compressor is a variable-speed refrigerant fluid compressor; and wherein the command input is operable to change the average working speed of the drying air propeller with respect to the default average speed corresponding to the selected laundry drying cycle irrespective of any change in an operating speed of the refrigerant fluid compressor.

* * * * *